US010702906B2

(12) United States Patent
Scomazzon et al.

(10) Patent No.: US 10,702,906 B2
(45) Date of Patent: Jul. 7, 2020

(54) FLARING DEVICE FOR FLARING THE ENDS OF PIPES

(71) Applicant: ANDEL TECHNOLOGY POLSKA SP. Z O.O, Mirków (PL)

(72) Inventors: Massimo Scomazzon, Bassano del Grappa (IT); Simone Tosin, Pianezze (IT); Hemanuel Piva, Bassano del Grappa (IT)

(73) Assignee: ANDEL TECHNOLOGY POLSKA SP. Z O.O., Mirkow (PL)

( * ) Notice: Subject to any disclaimer, the term of this patent is extended or adjusted under 35 U.S.C. 154(b) by 460 days.

(21) Appl. No.: 15/524,621

(22) PCT Filed: Oct. 28, 2015

(86) PCT No.: PCT/IB2015/058305
§ 371 (c)(1),
(2) Date: May 4, 2017

(87) PCT Pub. No.: WO2016/071806
PCT Pub. Date: May 12, 2016

(65) Prior Publication Data

US 2018/0297103 A1 Oct. 18, 2018

(30) Foreign Application Priority Data

Nov. 6, 2014 (IT) ..... VI2014A0287

(51) Int. Cl.
*B21D 41/00* (2006.01)
*B21D 41/02* (2006.01)

(52) U.S. Cl.
CPC ..... *B21D 41/023* (2013.01); *B21D 41/021* (2013.01)

(58) Field of Classification Search
CPC ..... B21D 41/021; B21D 37/02; B21D 37/04; B21D 37/10; B21D 19/00; B21D 19/046;
(Continued)

(56) References Cited

U.S. PATENT DOCUMENTS 2,774,408 A * 12/1956 Franck ..... B21D 41/04 72/317
2,924,263 A * 2/1960 Landis ..... B21D 41/02 72/117

(Continued)

FOREIGN PATENT DOCUMENTS

CN 2794679 5/2005
EP 0 501 928 A1 9/1992
EP 0501928 A1 * 9/1992 ..... B21D 41/021

*Primary Examiner* — Adam J Eiseman
*Assistant Examiner* — Bobby Yeonjin Kim
(74) *Attorney, Agent, or Firm* — Cherskov Flaynik & Gurda, LLC

(57) ABSTRACT

A pipe flaring device is described. The device includes a main body extending along a mainly longitudinal direction. The main body also includes a flaring unit. The flaring unit interacts with an end of pipe to be flared. The main body also includes a die carrier arranged at the front of the flaring unit; and a flaring die. The flaring die includes a center channel which houses the pipe to be flared. The device includes a conical inner surface whose tapered end diverges towards the flaring unit and so that the inner surface matches a conical outer surface of the flaring die.

18 Claims, 8 Drawing Sheets

(58) Field of Classification Search
CPC ..... B21D 39/08; B21D 39/12; B21D 41/02; B21D 41/023
USPC ..... 72/117, 370.11
See application file for complete search history.

(56) References Cited

U.S. PATENT DOCUMENTS

| | | | | | |
|---|---|---|---|---|---|
| 2,932,338 | A * | 4/1960 | Franck | B21D 41/04 | 72/322 |
| 5,090,226 | A * | 2/1992 | Takeoka | B21D 41/023 | 72/117 |
| 5,956,987 | A * | 9/1999 | Anthoine | B21D 41/02 | 72/117 |
| 8,291,737 | B2 * | 10/2012 | Huang | B21D 41/021 | 72/120 |
| 9,302,313 | B2 * | 4/2016 | Lin | B21D 41/021 | |
| 10,130,986 | B1 * | 11/2018 | Huang | B21D 41/021 | |
| 2006/0117827 | A1 * | 6/2006 | Kao | B21D 41/021 | 72/117 |
| 2006/0144116 | A1 * | 7/2006 | Buchanan | B21D 41/021 | 72/316 |
| 2006/0243019 | A1 * | 11/2006 | Shafer | B21D 41/021 | 72/453.16 |
| 2011/0192207 | A1 | 8/2011 | Huang | | |
| 2013/0133394 | A1 * | 5/2013 | Hasenberg | B21D 41/021 | 72/312 |
| 2015/0114068 | A1 * | 4/2015 | Hasenberg | B21D 41/021 | 72/312 |

* cited by examiner

FLARING DEVICE FOR FLARING THE ENDS OF PIPES

CROSS-REFERENCE TO RELATED APPLICATIONS

This application claims the benefit of priority as a nationalization of PCT application PCT/IB2015/058305, with an international filing date of Oct. 28, 2015, which in turn claimed priority to Italian application serial number VI2014A000287, filed on Nov. 6, 2014. The contents of each application are hereby incorporated by reference.

BACKGROUND OF THE INVENTION

1. Field of the Invention

The invention concerns an improved flaring device.

2. Background of the Invention

As is known, flaring devices serve to flare the ends of pipes, in particular of the copper pipes used to make circuits in hydraulic systems of various types.

The flaring devices of the known type substantially comprise a flaring unit configured in such a way that it advances against the end of the pipe to be flared, which is clamped in a die.

The flaring unit is provided with a conical flaring element that when in contact with the end of the pipe deforms it and obtains the desired flare.

Flaring devices of the type described above are disclosed, for example, in the patent document CN2794679 and include the use of several interchangeable dies with different diameters, which are associated with a flaring unit through mechanical fixing means, said flaring unit being provided with screw means for the advance movement towards the die.

The operator sets the flaring unit rotating, in such a way as to make it advance against the die and force the conical flaring element with which it is provided against the end of the pipe to be flared.

Flaring devices are also known, in which the die is just one and comprises two jaws that open like calipers and, cooperating with each other through contact, define a plurality of flared holes with different diameters, wherein each half of each hole is created in one of said jaws.

The die and the flaring unit are connected to each other through mechanical means that make it possible to arrange the conical flaring element with which the flaring unit is provided at the level of the hole made in the die whose diameter is suited to clamp the pipe to be flared.

All of the flaring devices mentioned above pose the drawback that the replacement of the dies or the displacement of the flaring element on the same die, at the level of the hole suited to accommodate the pipe to be flared, requires long processing times that affect processing costs. Furthermore, said flaring devices can be operated only manually.

The patent document U.S. Pat. No. 5,090,226 is also known, which describes a flaring device comprising a supporting structure configured in such a way that it supports a motor suited to drive a flaring unit and removably houses a flaring die.

The supporting structure is furthermore provided with a grip that makes the flaring device easy to maneuver for the operator. The coupling of the die with the supporting structure is obtained by means of a connection ring provided with coupling projections that allow the die to be axially fixed to the supporting structure. The flaring device disclosed in the patent mentioned above thus makes it possible to replace the die working on the connection element.

The drawback it poses lies in that each operation intended to remove the connection element, replace the die and fix a new die is rather long and when it is necessary to flare many pipes having a wide range of different diameters this considerably prolongs the time necessary to carry out the flaring process. Furthermore, another drawback is constituted by the high cost of said flaring devices, which is due especially to the production of the dies and of the connection rings.

A further and not less important drawback is constituted by the fact that it is impossible to operate the flaring device manually and therefore it cannot be used in areas where there is no power supply.

The document EP0501928A1 is also known, which describes a flaring device comprising a body provided with a lower jaw to which an upper jaw is hinged, wherein said jaws, when they are coupled together and opposite each other, define a seat whose inner profile is in the shape of a truncated cone, which is suited to accommodate a flaring die whose outer profile is in the shape of a truncated cone, too.

With regard to the flaring die, it comprises a lower portion and an upper portion that when coupled together, one opposite the other, define the housing for the pipe to be flared.

Furthermore, in the upper portion of the flaring die there is a projecting pin that fits in a corresponding hole provided in the upper jaw, in such a way as to define the position of the flaring die when this is received in the seat defined between the jaws. Finally, there are apposite clamping means that maintain the jaws clamped against each other and constrain the flaring die arranged between them in the operating position.

Also the flaring device described above poses the drawback that each operation for mounting/removing the die in/from the corresponding seat between the jaws requires the clamping means to be clamped/opened. Furthermore, the operation for mounting the die in the corresponding seat between the jaws requires that the pin provided on the upper portion of the die be first centered on and then inserted in the corresponding hole present in the upper jaw.

Substantially, in order to mount a die between the jaws it is necessary to:

- open the clamping means;
- lift the upper jaw from the lower jaw with a caliper-like rotation;
- place the lower die in the lower jaw;
- place the upper die in the upper jaw, taking care to center the pin in the corresponding hole;
- lower the upper jaw towards the lower jaw with a caliper-like rotation and position them in contact with each other, taking care that the respective dies correctly adhere to each other;
- clamp the clamping means.

It can thus be understood that the flaring device described in the above-mentioned patent document poses the drawback that each die mounting/removal operation is long and complex. Furthermore, the entire assembly constituted by the jaws with the respective reference elements, by the hinge for opening/clamping the jaws and by the clamping means is expensive to produce.

SUMMARY OF THE INVENTION

The present invention intends to overcome all of the drawbacks described above.

In particular, the invention concerns a flaring device that allows the flaring dies to be replaced more rapidly compared to the known flaring devices.

It is another object of the invention to provide a flaring device whose production costs are lower than those of known flaring devices equivalent to it.

It is another, yet not less important object of the invention to provide a flaring device having such construction characteristics that it can be operated both manually and through a motor.

The objects listed above are achieved by a flaring device whose characteristics are described in the main claim, to which reference is made.

Advantageously, in the flaring device of the invention replacing the dies is easier and quicker than in the known flaring devices. Consequently, it also offers the advantage of reducing the costs of the flaring operations.

BRIEF DESCRIPTION OF THE DRAWINGS

The objects and advantages described above are achieved by the flaring device that is the subject of the invention, which is described here below with reference to the attached drawings, wherein.

DETAILED DESCRIPTION OF THE INVENTION

The foregoing summary, as well as the following detailed description of certain embodiments of the present invention, will be better understood when read in conjunction with the appended drawings.

As used herein, an element step recited in the singular and preceded with the word "a" or "an" should be understood as not excluding plural said elements or steps, unless such exclusion is explicitly stated. Furthermore, the references to "one embodiment" of the present invention are not intended to be interpreted as excluding the existence of additional embodiments that also incorporate the recited features. Moreover, unless explicitly stated to the contrary, embodiments "comprising" or "having" an element or a plurality of elements having a particular property may include additional such elements not having that property.

The flaring device of the invention is represented in FIGS. 1 to 4, where it is indicated as a whole by 1.

Figure 9:
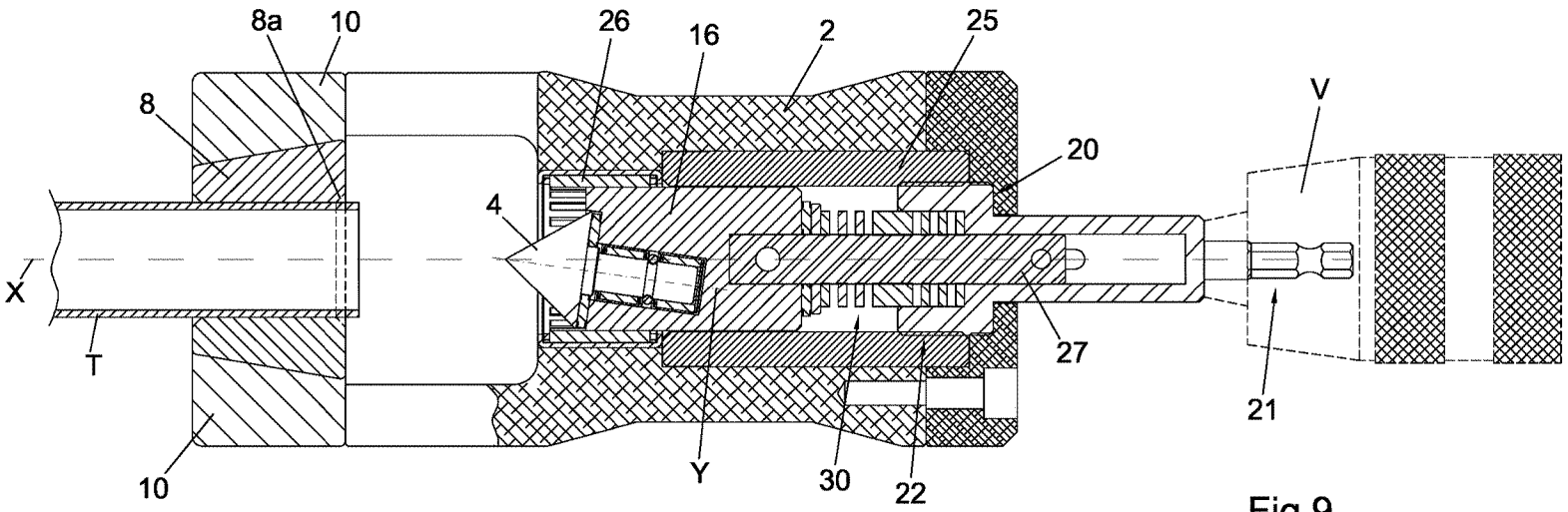
FIGS. 9 and 10 show the flaring device of FIGS. 3 and 4 in two steps of the flaring process.
Figure 10:
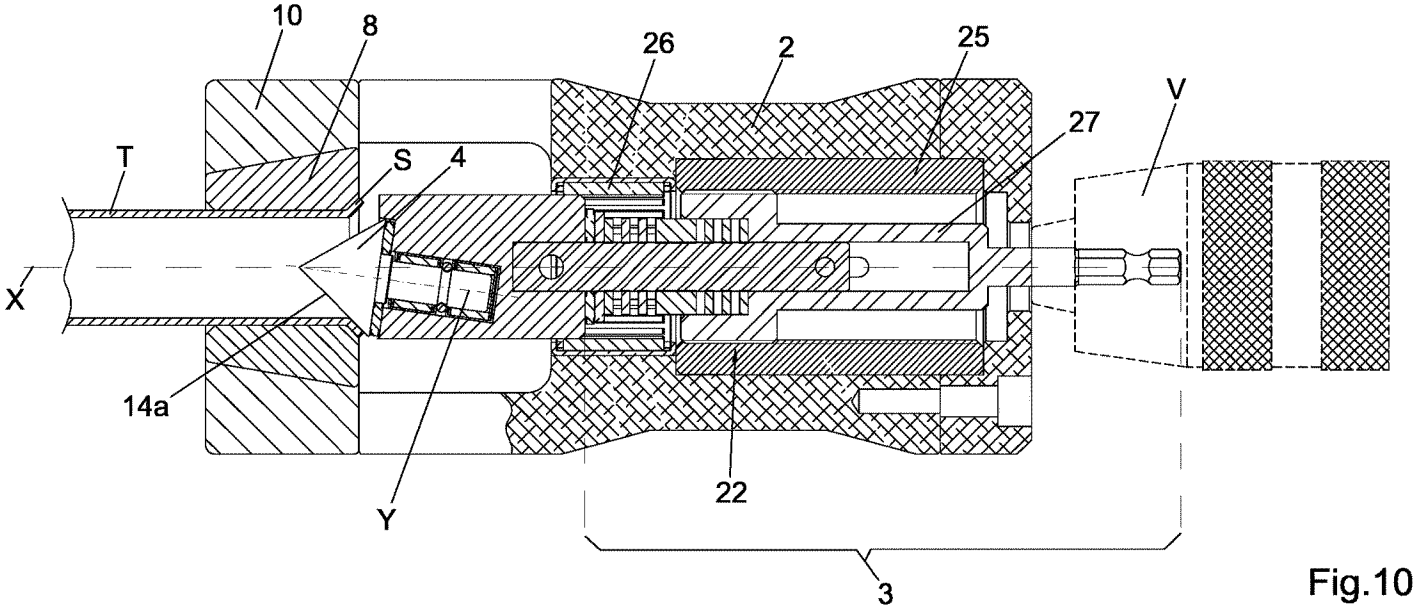

It is used to flare the ends of pipes T, as shown in FIGS. 9 and 10, and comprises a main body 2 that develops along a mainly longitudinal direction defined by a longitudinal axis X.

In the main body 2 there are a flaring unit 3 provided with a flaring cone 4 configured in such a way that it interacts with the end of the pipe T to be flared and a die carrier 10 that accommodates a flaring die 8, arranged in front of the flaring unit 3.

The flaring die 8, which can be observed in FIGS. 5 to 8, is accommodated in the die carrier 10 and is provided with a center channel 9 configured so as to house the pipe T to be flared.

In the embodiment described herein, the die carrier 10 is fixed to the main body 2 by means of screws 10*a*.

A different embodiment is however possible, in which the die carrier 10 constitutes a single piece together with the main body 2.

According to the invention, in the die carrier 10 there is a shaped seat 11 that is configured so as to accommodate the flaring die 8 and communicates with a shaped opening 14 made in the main body 2 and included between the flaring unit 3 and the die carrier 10, said shaped seat 11 being defined by a conical inner surface 12 with taper diverging towards the flaring unit 3 and configured so that it can be coupled with the conical outer surface 13 of the flaring die 8. As regards the shaped opening 14, it can be observed that it is made in the lateral surface 2*a* of the main body 2 and its length 14*a*, measured along the longitudinal axis X, exceeds the length 8*a* of the flaring die 8, measured along the longitudinal axis X, too.

As regards the width 14*b* of the shaped opening 14, it can be observed that said width, measured crosswise with respect to the longitudinal axis X, exceeds the width 8*b* of the flaring die 8 and also the width 11*b* of the shaped seat 11, both measured crosswise with respect to the longitudinal axis X. Finally, it can be observed that the width 14*b* of the shaped opening 14, measured crosswise with respect to the longitudinal axis X, is shorter than the width 2*b* of the main body 2, measured crosswise with respect to the longitudinal axis X, too.

Finally, the shaped opening 14 makes up a pocket that extends over a portion of the lateral surface of the main body 2.

It allows the flaring die 8 to be inserted in the corresponding die carrier 10 through two successive displacements that comprise:

a first displacement in a direction that is orthogonal to the longitudinal axis X, allowing the flaring die 8 to be inserted in the main body 2 in a coaxial position with respect to the longitudinal axis X;

a second displacement along the longitudinal axis X and towards the die carrier 10, allowing the conical inner surface 12 of the shaped seat 11 and the corresponding conical outer surface 13 of the flaring die 8 to be placed in contact with each other.

It can also be observed that the die carrier 10 is provided with a through opening 15 that develops according to the direction defined by the longitudinal axis X and communicates with the shaped opening 14.

Said through opening 15 allows the operator holding the portion of the pipe T that projects from the flaring die 8 to insert the flaring die 8, with the pipe T to be flared associated with it, first inside the shaped opening 14 and then in the die carrier 10, as can be observed in FIGS. 9 and 10.

The special construction structure of the flaring device of the invention, and in particular the presence of the shaped opening 14 with the dimensional characteristics indicated above, allows the flaring die to be mounted/removed more quickly.

Furthermore, as the die carrier 10 is produced in a single piece, the lamping/opening hinge means and the locking means described in the known patent document EP 0 501 928 A1 are eliminated.

As regards the flaring unit 3, it can be observed that it comprises a center core 16 coaxially associated into the main body 2 according to the longitudinal axis X and the already mentioned flaring cone 4, belonging to the center core 16, facing towards the flaring die 8.

Maneuvering means 19 are also provided for displacing the center core 16 coaxially inside the main body 2 and along the longitudinal axis X.

The maneuvering means 19, as can be observed, comprise a tube 20 mechanically associated with the center core 16 through a connection rod 27 and provided with a maneuvering member 21 that projects from the main body 2 on the opposite side of the flaring cone 4 and with screw means 22 that connect the tube 20 to a sleeve 25 located inside the main body 2.

As regards the screw means 22, it can be observed that they comprise a male thread 23 created on the outside of the tube 20 and a female thread 24 configured so that it matches the male thread 23 and created in the sleeve 25.

The sleeve 25 is stably coupled into the main body 2 and the center core 16 slides inside it according to the longitudinal axis X.

There is also a bearing 26, preferably but not necessarily of the type with rollers, which is arranged so as to be coaxially aligned with the sleeve 25 inside the main body 2 and in which the center core 16 slides.

The tube 20, as already explained, is mechanically associated with the center core 16 through the connection rod 27, which has a first end 27*a* fixed to the center core 16 and a second end 27*b*, opposite the first end 27*a*, which is slidingly associated in the tube 20 through a pin 28 fixed to the second end 27*b* and slidingly associated in a slot 29 made in the tube 20.

Furthermore, it is possible to observe the presence of an elastic unit 30 coaxially associated with the outside of the connection rod 27 and interposed between the center core 16 and the tube 20.

The elastic unit 30 in turn comprises a counteracting ring 31 associated in an intermediate position with the connection rod 27 and two elastic elements comprising a first elastic element 32, included between the counteracting ring 31 and the center core 16, and a second elastic element 33 that is included between the same counteracting ring 31 and the tube 20.

It can furthermore be noted that the maneuvering member 21 of said tube 20 is provided with shaped portions 21*a* suited to be coupled with mechanical rotation means, like for example an electric drill or screwdriver, but also configured to allow a possible manual maneuver to be performed on the tube 20 by rotating it manually using a maneuvering wrench of the type known per se.

As regards the flaring cone 4, it can be noted that it is provided with a pin 7 housed in a hole 7*a* made in the center core 16 where it defines a direction Y incident on the longitudinal axis X in the vertex 4*a* of the flaring cone 4. Furthermore, rolling means 17 are interposed between the pin 7 and the hole 7*a*, wherein said rolling means preferably but not necessarily comprise one or more bearings and rollers.

The configuration of the flaring unit just described above allows the flaring cone 4 to be moved forward against the pipe T to be flared when the tube 20 is set rotating through the maneuvering member 21.

In this way, the screw means 22 make the center core 16 and the flaring cone 4 advance inside the sleeve 25 and the bearing 26 through a sliding movement according to the longitudinal axis X.

At the same time, the connection rod 27 also sets the center core 16 rotating around the same longitudinal axis X in such a way as to transmit a conical movement to the flaring cone 4 whose lateral surface 4*b* comes into contact with the end of the pipe T and deforms it, producing the flare S that can be observed in FIG. 10.

In particular, the flare S at the end of the pipe T is obtained through plastic deformation of the end of the pipe T included between the flaring cone 4 and the chamfer 8*d* of the flaring die 8 that delimits the center channel 9 of the flaring die 8 itself.

The latter, as can be observed in particular in FIGS. 4 to 8, comprises two shaped cores 8*b*, 8*c* that are connected to each other and can be mutually opened as a caliper through an elastic rotation unit 40.

Figure 1:
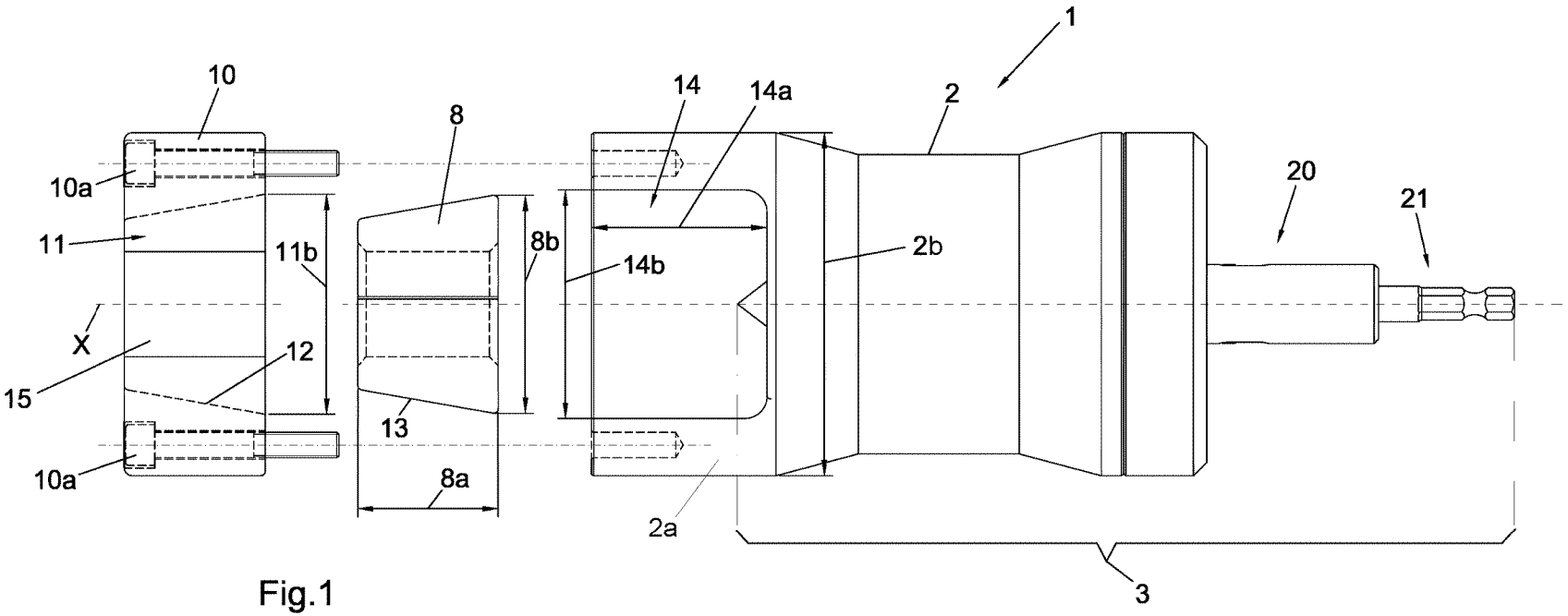
FIG. 1 shows a view of the flaring device of the invention.
Figure 2:
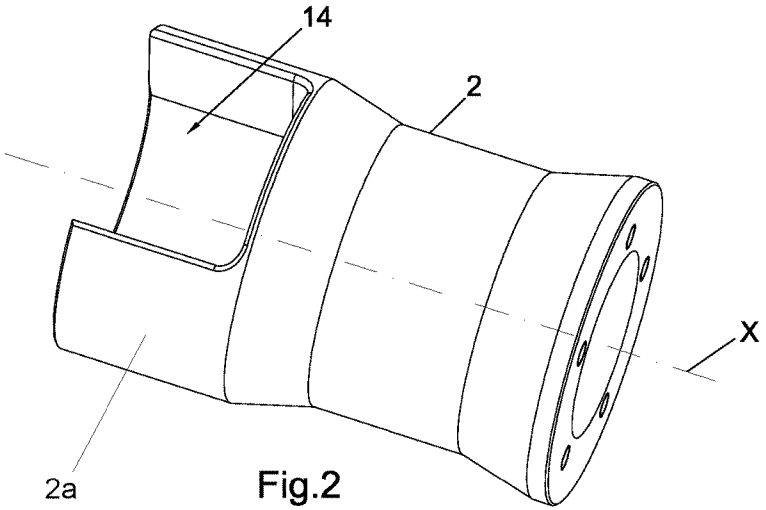
FIG. 2 shows an axonometric view of a portion of the flaring device of FIG. 1.
Figure 3:
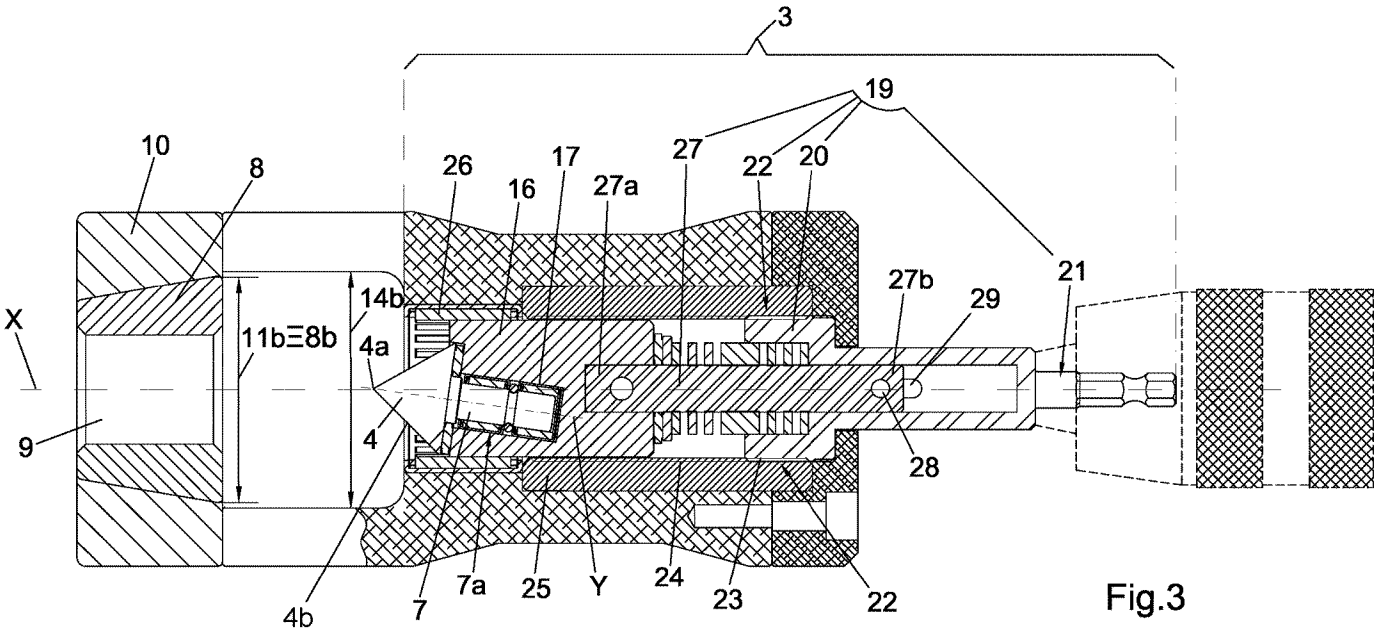
FIG. 3 shows a sectional view of FIG. 1 obtained according to the drawing layer of FIG. 1.
Figure 4:
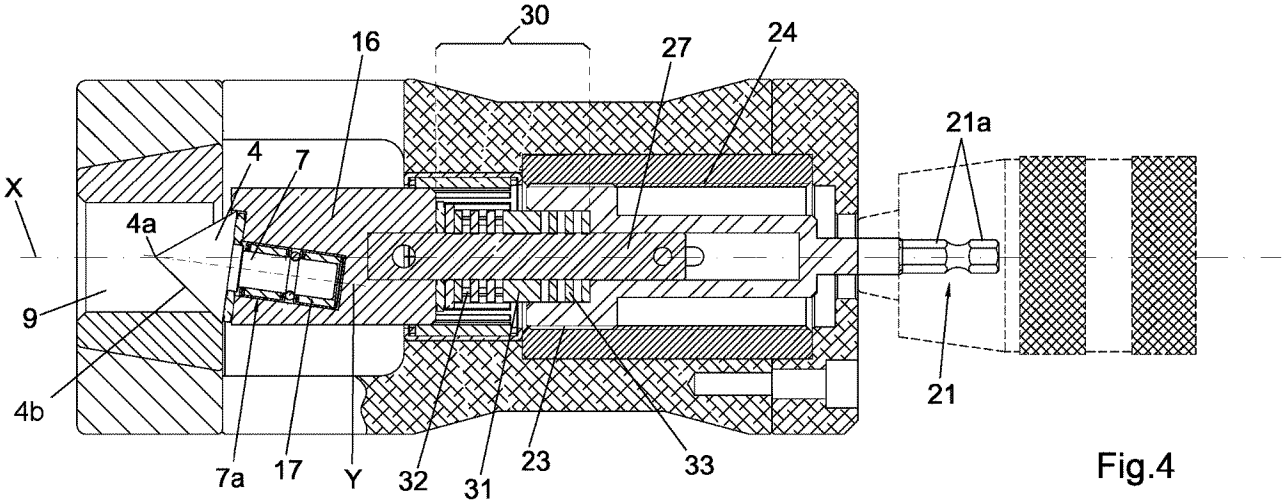
FIG. 4 shows the sectional view of FIG. 3 in a different operating configuration.
Figure 5:
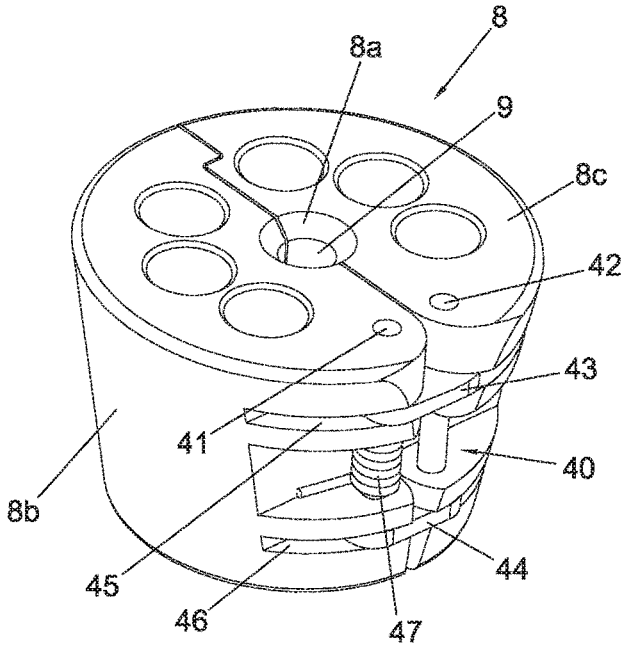
FIG. 5 shows an axonometric view of the flaring die suited to be associated with the flaring device represented in FIGS. 1 to 4.
Figure 6:
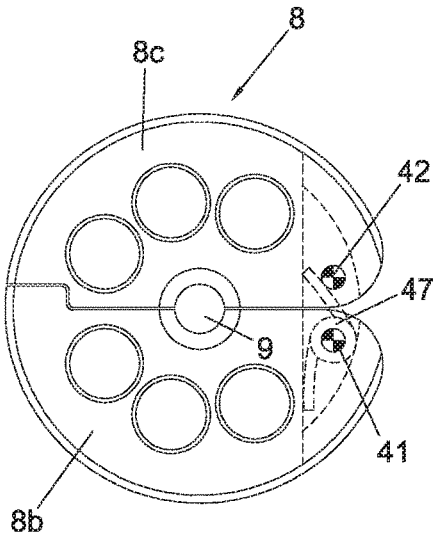
FIGS. 6 and 7 show two plan views of the die of FIG. 5 respectively in the clamped and in the open configuration.
Figure 7:
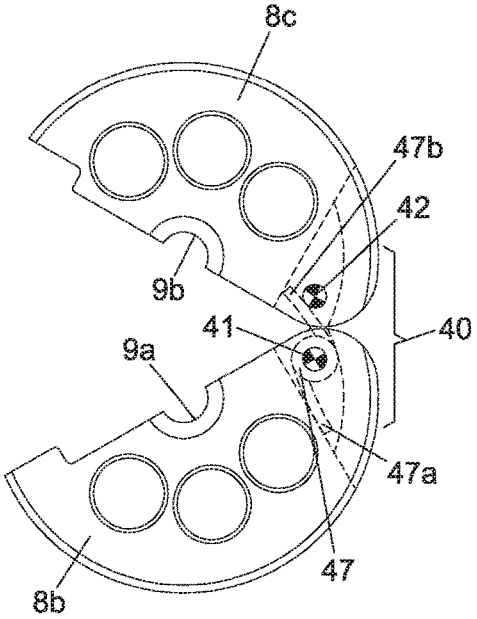
Figure 8:
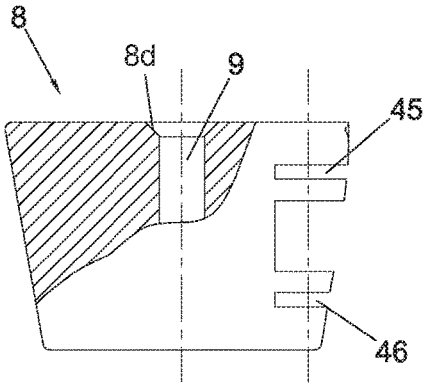
FIG. 8 shows a partial sectional view of the die of FIG. 5.

A half 9*a*, 9*b* of the center channel 9 is created in each one of the shaped cores 8*b*, 8*c* and the center channel is thus formed when both of the shaped cores 8*b*, 8*c* face each other, as shown in FIGS. 5 and 6.

As regards the elastic rotation unit 40, it can be observed that it comprises a pair of pins 41, 42, each one of which is coupled in a corresponding shaped core 8*b*, 8*c* and is arranged so that it passes through two joining brackets 43, 44, each one of the latter being housed in a corresponding seat 45, 46 that extends over both of the shaped cores 8*b*, 8*c*.

Therefore, the shaped cores 8*b*, 8*c* can rotate with respect to each other with a caliper movement that is made elastic by the presence of a helical spring 47 having one end 47*a* in contact with the shaped core 8*b* to which the pin 41 belongs, while the other end 47*b* interferes with the pin 42 belonging to the other shaped core 8*c*.

Therefore, the presence of the helical spring 47 makes the mutual opening and clamping of the shaped cores 8*b*, 8*c* elastic and keeps them clamped, one facing the other, when the pipe T to be flared is included between them. Operatively, when it is necessary to flare a pipe T, the shaped cores 8*b*, 8*c* of the flaring die 8 are separated in such a way as to accommodate the pipe T to be flared in the center channel 9.

When the pipe T to be flared is clamped between the shaped cores as a result of the elastic thrust exerted by the helical spring 47, the operator holds the free end of the pipe T to be flared, inserts the flaring die 8 in the shaped seat 11 with a movement directed crosswise with respect to the longitudinal axis X and thus makes the flaring die 8 move according to the longitudinal axis X in order to insert it in the die carrier 10 in the configuration shown in FIG. 9.

It should be noted that the fact that the taper of the inner surface of the die carrier 10 and the taper of the outer surface of the flaring die 8 match each other guarantees the centering of the pipe T to be flared with respect to the longitudinal axis X and to the flaring cone 4.

At this point it is sufficient for the operator to set the maneuvering member 21 of the tube 20 rotating, for example through a motor-driven rotary spindle V, so that the center core 16 advances towards the pipe T to be flared, until the flaring cone 4 comes into contact with the pipe T and deforms its end obtaining the flare S coupled with the chamfer 8*d* of the flaring die 8.

Once the flaring operation has been completed, it is sufficient to set the maneuvering member 21 rotating in the direction opposite the screwing direction in order to move the flaring cone 4 away from the flaring die 8 and allow the latter to be extracted through the shaped opening 14.

The shaped cores 8*b*, 8*c* of the flaring die 8 are then opened in order to extract the flared pipe T.

Obviously, the flaring device will be provided with several flaring dies 8, each having a center channel 9 with different diameter, so that different pipes can be accommodated therein, but all of them will have the same conical outer surface 13, so that they can all be accommodated in the same die carrier 10. Variant embodiments of the flaring die just described above are possible, comprising both of the shaped cores or several shaped cores, in each one of which a portion of said center channel is created, said center channel being defined when the shaped cores are maintained adherent to each other by joining means.

The center channel has circular cross section and is provided with the chamfer facing towards the flaring unit 3.

A variant embodiment of the flaring die is shown in FIGS. 11 to 14, where it is indicated as a whole by 50.

Figure 13:
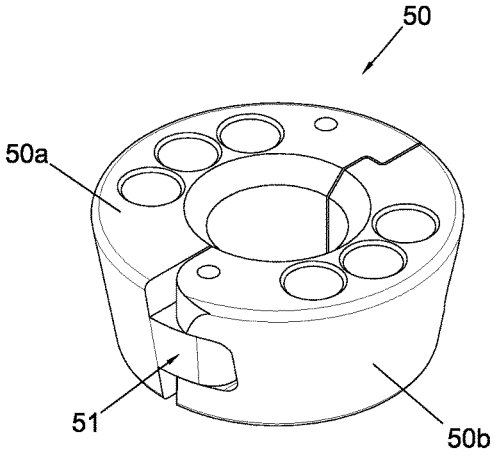
Figure 14:
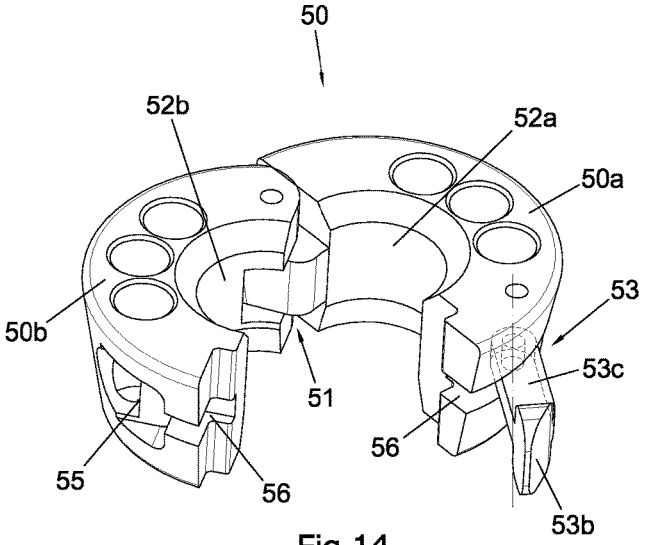

25 It can be observed that it comprises two shaped cores 50*a*, 50*b*, which are connected to each other through a hinge element 51, visible in particular in FIGS. 13 and 14, which makes it possible to mutually open and clamp them with a caliper movement.

Figure 11:
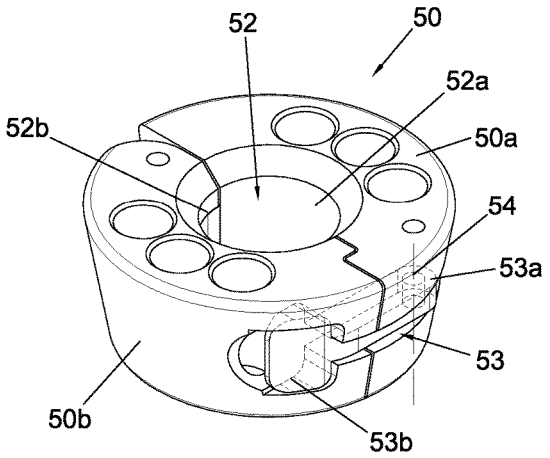
FIGS. 11 to 14 show different views of a variant embodiment of the flaring die shown in FIGS. 5 to 8.
Figure 12:
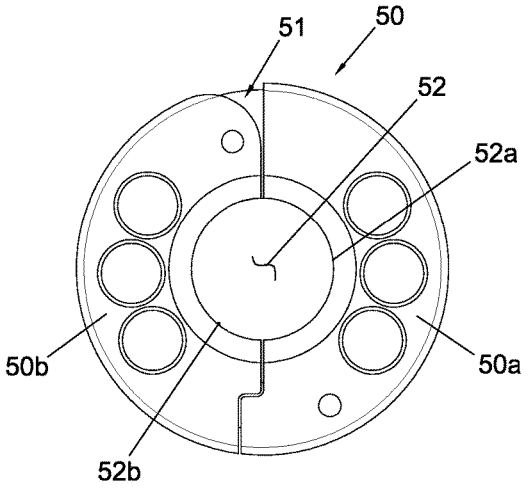

In each one of the shaped cores 50*a*, 50*b* there is a half 52*a*, 52*b* of the center channel 52 with truncated cone-shaped profile that is formed when the flaring die 50 is clamped and both of the shaped cores 50*a*, 50*b* that make it up face each other, as can be observed in FIGS. 11 to 13.

There are joining means suited to join the shaped cores, comprising a lever 53 arranged on the opposite side of the hinge 51 and visible in FIGS. 11 and 14, which constrains the shaped cores 50*a*, 50*b* to each other in the clamped position when these are arranged opposite each other, as shown in FIG. 11. For this purpose, the lever 53 has a first end 53*a* revolvingly connected to one of the shaped cores through a pin 54, for example to the first shaped core 50*a* of a second end 53*b* suited to be maneuvered by the operator and housed in a seat 55 obtained in the second shaped core 50*b*.

Furthermore, a groove 56 obtained in both of the shaped cores 50*a*, 50*b* and communicating with the seat 55 of the lever 53 houses the body 53*c* of the same lever 53 when its second end 53*b* is housed in the seat 55, as shown in FIG. 11.

Figure 16:
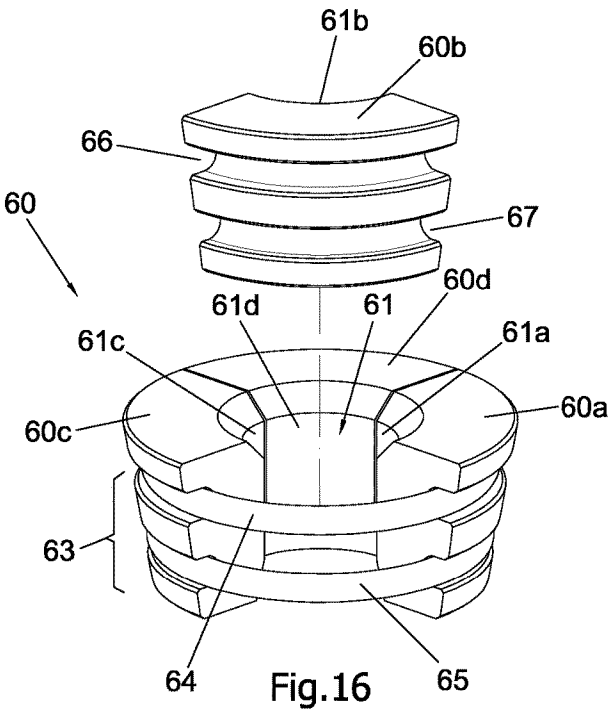
FIGS. 15 to 17 show different views of another variant embodiment of the flaring die shown in FIGS. 5 to 8.
Figure 17:
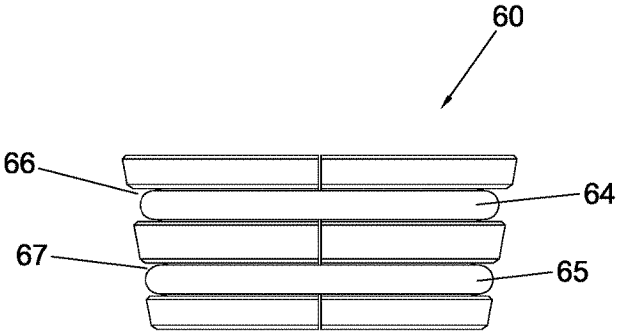

Starting from the clamped configuration of the flaring die 50 shown in FIG. 11, by acting on the second end 53*b* of the lever 53 it is possible to rotate the lever 53 until it is arranged in the configuration shown in FIG. 14, in which the shaped cores 50*a*, 50*b* that make it up can be separated from each other. Another variant embodiment of the flaring die is represented in FIGS. 15 to 17, where it is indicated as a whole by 60.

It can be observed that it comprises four shaped cores 60*a*, 60*b*, 60*c*, 60*d*, each one of which defines an angular sector of the flaring die 60 for an amplitude of 90°.

Figure 15:
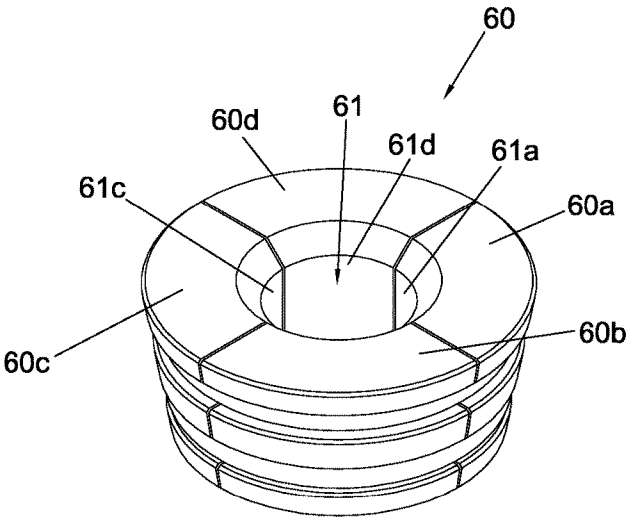

In each one of the shaped cores 60*a*, 60*b*, 60*c*, 60*d* there is a quarter 61*a*, 61*b*, 61*c*, 61*d* of the center channel 61 with truncated cone-shaped profile that is formed when the flaring die 60 is clamped and the shaped cores that make it up are maintained mutually adherent by joining means indicated as a whole by 63, arranged circumferentially outside them, as shown in FIG. 15.

It can be observed, in particular, that the joining means 63 comprise two elastic rings 64, 65 housed in corresponding annular grooves 66, 67 created circumferentially on the outside of the shaped cores 60*a*, 60*b*, 60*c*, 60*d*. Usually, the elastic rings 64, 65 force the shaped cores 60*a*, 60*b*, 60*c*, 60*d* radially towards the center, so that they are maintained adherent to one another and to the pipe to be flared that is included between them.

On the other hand, in order to space the shaped cores 60*a*, 60*b*, 60*c*, 60*d* from one another, it is sufficient to force them radially towards the outside, overcoming the elastic force exerted by the elastic rings 64, 65.

A further variant embodiment of the flaring die is represented in FIGS. 18 to 21, where it is indicated as a whole by 70.

It can be observed that it comprises two shaped cores 70*a*, 70*b*, which are connected to each other through a hinge element 71 that makes it possible to mutually open and clamp them with a caliper movement.

Figure 18:
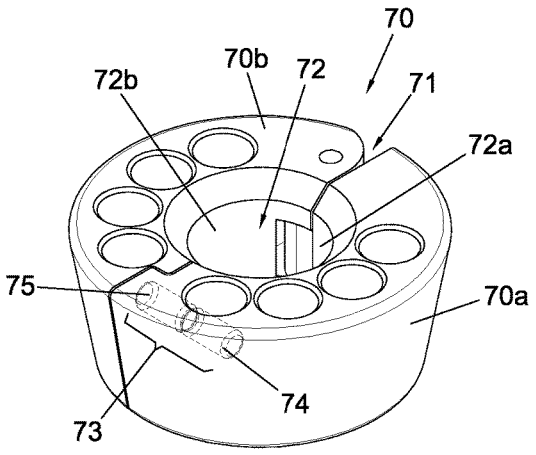
FIGS. 18 to 21 show different views of a further variant embodiment of the flaring die shown in FIGS. 5 to 8.
Figure 19:
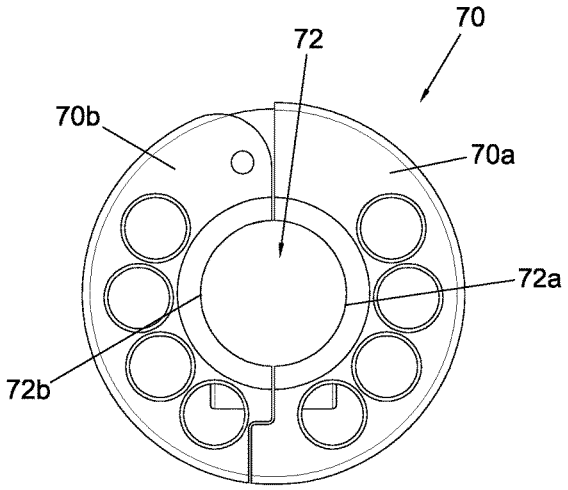
Figure 20:
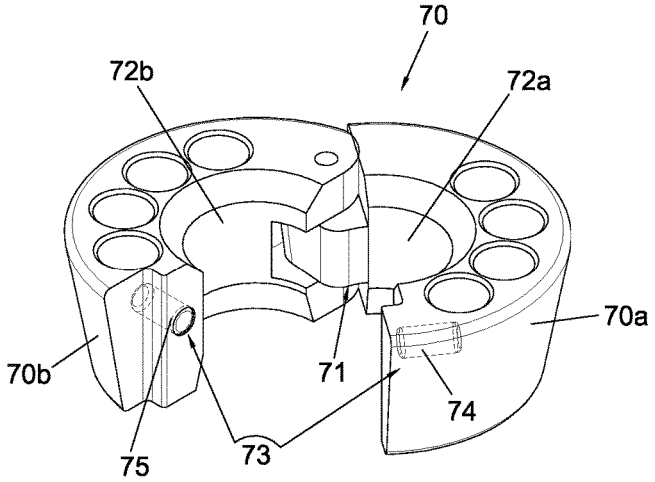
Figure 21:
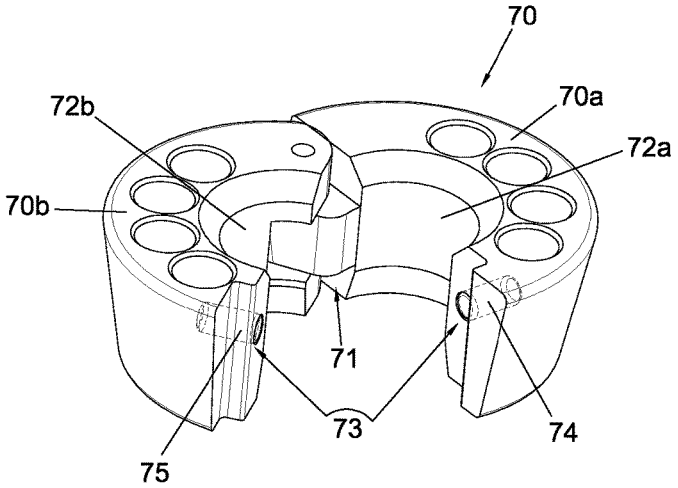
Figure 22:
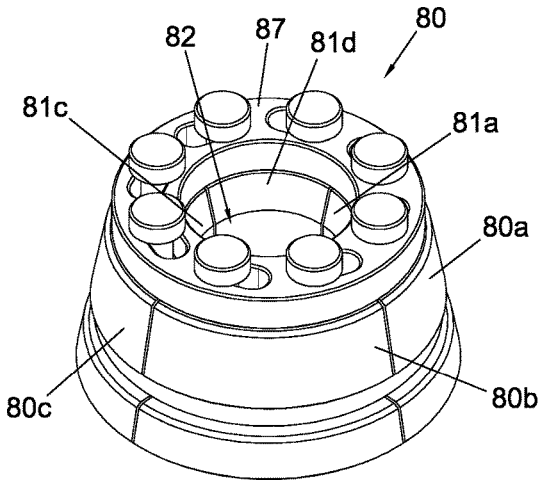
FIGS. 22 to 25 show different views of another different embodiment of the flaring die shown in FIGS. 5 to 8.
Figure 23:
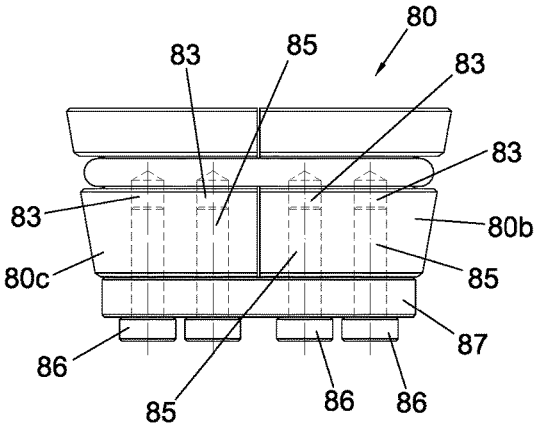

In each one of the shaped cores 70*a*, 70*b* there is a half 72*a*, 72*b* of the center channel 72 with truncated cone-shaped profile that is formed when the flaring die 70 is clamped and both the shaped cores 70*a*, 70*b* that make it up are facing each other, as shown in FIGS. 18 and 19.

On the opposite side of the hinge element 71 there are the joining means comprising a magnetic closure indicated as a whole by 73 that comprises a first magnetic element 74 and a second magnetic element 75, each one 10 belonging to a corresponding shaped core 70*a*, 70*b*, with opposite polarities and opposing each other.

In this way, when the flaring die 70 is clamped the shaped cores 70*a*, 70*b* remain adherent to each other due to the mutual magnetic attraction generated by the magnetic elements 74, 75 when they are arranged so that they face each other.

Another and not less important variant embodiment of the flaring die is shown in FIGS. 22 to 25, where it is indicated as a whole by 80.

It can be observed that it comprises four shaped cores 80*a*, 80*b*, 80*c*, 80*d*, each one of which defines an angular sector of the flaring die 80 for an amplitude of 90°.

In each one of the shaped cores 80*a*, 80*b*, 80*c*, 80*d* there is a quarter 81*a*, 81*b*, 81*c*, 81*d* of the center channel 82 with truncated cone-shaped profile that is formed when the flaring die 80 is clamped.

The shaped cores 80*a*, 80*b*, 80*c*, 80*d* are provided with a plurality of holes 83 parallel to one another and arranged according to a circumference Z, drawn with a broken line, concentric with the longitudinal axis of symmetry Y of the flaring die 80, in each one of which a pin 85 provided with a head 86 is inserted.

The joining means comprise said pins 85 and an annular ring nut 87 provided with a plurality of slotted holes 88, which is arranged so that it faces and is in contact with the shaped cores 80*a*, 80*b*, 80*c*, 80*d* and is included between the beneath the head of each head 86 of the pins 85 and the underlying shaped cores 80*a*, 80*b*, 80*c*, 80*d*.

Figure 24:
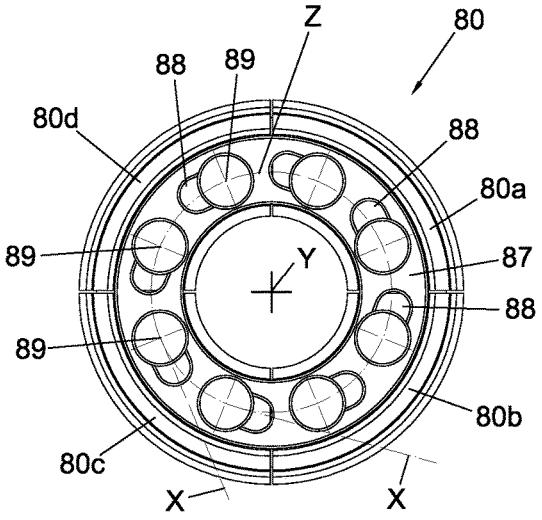
Figure 25:
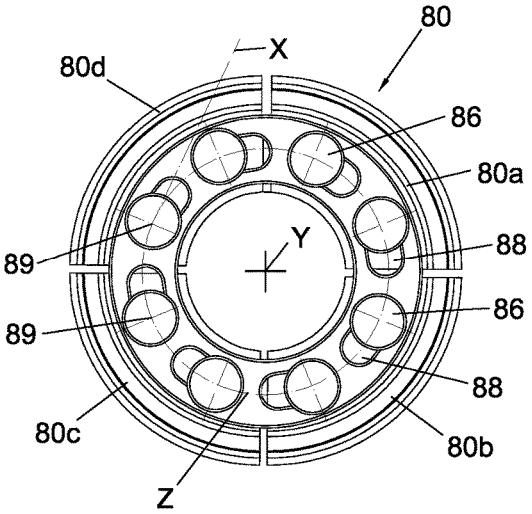

Each one of said pins 85 is thus inserted also in a corresponding slotted hole 88, wherein each slotted hole 88 defines a longitudinal axis of symmetry X that, as shown in FIGS. 24 and 25, is tangential to the already mentioned circumference Z to which the centers 89 of the pins 85 and of the respective heads 86 belong.

In this way, when the annular ring nut 87 is rotated, the walls of the slotted holes 88 force the pins 85, and thus also the shaped cores 80*a*, 80*b*, 80*c*, 80*d* that are integral with them, to move away from or towards each other in a radial direction with respect to the longitudinal axis of symmetry Y of the flaring die 80.

Thus, for example, in the configuration shown in FIG. 24 the shaped cores 80*a*, 80*b*, 80*c*, 80*d* are close to each other, as the pins 85 are in the position nearest to the longitudinal axis of symmetry Y and clamp the pipe to be flared between them.

Vice versa, if the annular ring nut 87 is rotated in the configuration shown in FIG. 25, the pins 85 come to be in the position furthest away from the longitudinal axis of symmetry Y of the flaring die 80, which therefore is in the open configuration with the shaped cores 80*a*, 80*b*, 80*c*, 80*d* spaced from one another.

Based on the description provided above, it can be understood that the flaring device that is the subject of the invention achieves all of the set objects. In particular, the flaring device of the invention allows the flaring dies to be rapidly replaced compared to the known flaring devices equivalent to it and thus shortens the processing times compared to the known art.

Furthermore, the flaring device of the invention has lower production costs than the known flaring devices equivalent to it that are motor driven.

Finally, the flaring device of the invention can be operated either manually or through a motor, for example using drills or screw drivers of the known type.

During the construction process, the flaring device of the invention can be subjected to modifications or construction variants intended to improve its functionality or make its construction more economical.

It is understood, however, that said possible modifications or variants must all be considered protected by the present invention, provided that they fall within the scope of the following claims.

In summary, an embodiment of the invention is a flaring device 1 for flaring the ends of pipes T, comprising a main body 2 that defines a longitudinal axis X, in which it is possible to identify: a flaring unit 3 suited to flare the end of the pipe T; a die carrier 10 arranged in front of and coaxial with the flaring unit 3 according to the longitudinal axis X; a flaring die 8; 50; 60; 70; 80 configured so that it can be accommodated in the die carrier 10 and having a center channel 9 suited to house the pipe T. The die carrier 10 has a shaped seat 11 that houses the flaring die 8; 50; 60; 70; 80 and communicates with a shaped opening 14 present in the main body 2 and included between the flaring unit 3 and the die carrier 10. The shaped seat 11 is defined by a conical inner surface 12 whose taper diverges towards the flaring unit 3 and being configured so that it matches the conical outer surface 13 of the flaring die 8; 50; 60; 70; 80. The shaped opening 14 is made in the lateral surface 2*a* of the main body 2 and its length 14*a* exceeds the length 8*a* of the flaring die 8; 50; 60; 70; 80, both measured along the longitudinal axis X, while its width 14*b* exceeds both the width 8*b* of the flaring die 8; 50; 60; 70; 80 and the width 11*b* of the shaped seat 11, measured crosswise with respect to the longitudinal axis X.

One flaring device 1 suited to flare the ends of pipes T is described. It comprises a main body 2 that develops along a mainly longitudinal direction defined by a longitudinal axis X, the following being provided in said main body 2: a flaring unit 3 configured in such a way as to interact with the end of said pipe T to be flared; a die carrier 10 arranged at the front of said flaring unit 3; a flaring die 8; 50; 60; 70; 80 configured in such a way that it can be accommodated in said die carrier 10 and provided with a center channel 9 configured so as to house said pipe T to be flared. The die carrier 10 being provided with a shaped seat 11 configured so as to accommodate said flaring die 8; 50; 60; 70; 80 and communicating with a shaped opening 14 made in said main body 2, said shaped opening 14 being included between said flaring unit 3 and said die carrier 10, said shaped seat 11 being defined by a conical inner surface 12 whose taper diverges towards said flaring unit 3 and being configured so that it matches the conical outer surface 13 of said flaring die 8; 50; 60; 70; 80, characterized in that said shaped opening 14 is made in the lateral surface 2*a* of said main body 2, in that the length 14*a* of said shaped opening 14, measured along said longitudinal axis X, exceeds the length 8*a* of said flaring die 8; 50; 60; 70; 80, also measured along said longitudinal axis X, and in that the width 14*b* of said shaped opening 14, measured crosswise with respect to said longitudinal axis X, exceeds the width 8*b* of said flaring die 8; 50; 60; 70; 80 and the width 11*b* of said shaped seat 11, both measured crosswise with respect to said longitudinal axis X.

The flaring device 1 described above may further be characterized in that the width 14*b* of said shaped opening 14, measured crosswise with respect to said longitudinal axis X, is smaller than the width 2*b* of said main body 2, also measured crosswise with respect to said longitudinal axis X.

The flaring device as described above may also be characterized in that said die carrier 10 is provided with a through opening 15 that develops along the direction defined by said longitudinal axis X and that communicates with said shaped opening 14.

The flaring device as described above may also be characterized in that said flaring unit 3 comprises: a center core 16 coaxially associated into said main body 2 according to said longitudinal axis X; a flaring cone 4 belonging to said center core 16 and facing towards said flaring die 8; 50; 60; 70; 80; a maneuvering means 19 suited to move said center core 16 coaxially inside said main body 2 and along said longitudinal axis X.

The flaring device as described above may be characterized in that said flaring cone 4 is provided with a pin 7 housed in a hole 7*a* made in said center core 16 where it defines a direction Y incident on said longitudinal axis X, rolling means 17 being interposed between said pin 7 and said hole 7*a*.

The flaring device described above may be characterized in that said maneuvering means 19 comprise: a tube 20 mechanically associated with said center core 16 and provided with a maneuvering member 21 that projects from said main body 2 on the opposite side of said flaring cone 4; a screw means 22 for connecting said tube 20 inside said main body 2.

The flaring device 1 as described above may also be characterized in that said screw means 22 comprises a male thread 23 created on the outside of said tube 20 and a female thread 24 created in a sleeve 25 that is stably coupled into said main body 2 and into which said center core 16 is slidingly coupled.

The flaring device as described above may be characterized in that it comprises a bearing 26 arranged in such a way that it is coaxially aligned with said sleeve 25 and interposed between said main body 2 and said center core 16.

The flaring device as described above may be characterized in that said tube 20 is mechanically associated with said center core 16 through a connection rod 27 having a first end 27*a* fixed to said center core 16 and a second end 27*b*, opposite said first end 27*a*, slidingly associated into said tube 20 to which it is connected through a pin 28 fixed to said second end 27*b* and slidingly associated into a slot 29 made in said tube 20.

The flaring device as described above may be characterized in that it comprises an elastic unit 30 coaxially associated with the outside of said connection rod 27 and interposed between said center core 16 and said tube 20.

The flaring device as described above may be characterized in that said flaring die 8; 50; 60; 70; 80 comprises two or more shaped cores 8*b*, 8*c*; 50*a*, 50*b*; 60*a*, 60*b*, 60*c*, 60*d*; 70*a*, 70*b*; 80*a*, 80*b*, 80*c*, 80*d*, in each one of which there is a section 9*a*, 9*b*; 52*a*, 52*b*; 61*a*, 61*b*, 61*c*, 61*d*; 72*a*, 72*b*; 81*a*, 81*b*, 81*c*, 81*d* of said center channel 9; 52; 61; 72; that is defined when said shaped cores 8*b*, 8*c*; 50*a*, 50*b*; 60*a*, 60*b*, 60*c*, 60*d*; 70*a*, 70*b*; 80*a*, 80*b*, 80*c*, 80*d* are maintained adherent to each other by 10 joining means, said center channel 9; 52; 61; 72; 82 having a circular cross section and being provided with a chamfer 8*d* facing towards said flaring unit 3.

The flaring device as described above may be characterized in that said flaring die 8 comprises two shaped cores 8*b*, 8*c* that are connected to each other and are suited to be mutually opened like calipers through an elastic rotation unit 40, a half 9*a*, 9*b* of said center channel 9 being present in each one of said shaped cores 8*b*, 8*c*.

The flaring device as described above may be characterized in that said elastic rotation unit 40 comprises a pair of pins 41, 42, each coupled into a corresponding shaped core 8*b*, 8*c* and arranged so that it passes through at least one joining bracket 43, 44 housed in a seat 45, 46 that extends over both of said shaped cores 8*b*, 8*c*, wherein a helical spring 47 is externally coupled with at least one of said pins 41, said helical spring having one end 47*a* that is placed in contact with one of said shaped cores 8*b* and the other end 47*b* that interferes with the other pin 42.

The flaring device as described above may be characterized in that said flaring die 50; 70 comprises two shaped cores 50*a*, 50*b*; 70*a*, 70*b*, in each one of which there is a half 52*a*, 52*b*; 72*a*, 72*b* of said center channel 52; 72, said shaped cores 50*a*, 50*b*; 70*a*, 70*b* being connected to each other through a hinge element 51; 71 that allows them to be opened like calipers and being provided with joining means arranged on the opposite side of said hinge element 51; 71.

The flaring device as described above may be characterized in that said joining means comprise a lever 53 having a first end 53*a* connected to a first shaped core 50*a* through a pin, a second end 53*b* suited to be maneuvered by the operator and configured so that it can be housed in a seat provided in a second shaped core 50*b*, and a body 53*c* included between said ends 53*a*, 53*b*, configured so that it can be housed in a groove obtained in both of said shaped cores 50*a*, 50*b*.

The flaring device as described above may be characterized in that said joining means comprise a magnetic closure 73 comprising a first magnetic element 74 and a second magnetic element 75 opposing each other, each belonging to a corresponding shaped core 70*a*, 70*b*.

The flaring device as described above may be characterized in that said flaring die 60 comprises four shaped cores 60*a*, 60*b*, 60*c*, 60*d*, in each one of which there is a quarter of said center channel 61, said joining means comprising at least one elastic ring 64, 65 housed in an annular groove 66, 67 created on the outside of said shaped cores 60*a*, 60*b*, 60*c*, 60*d*.

The flaring device as described above may be characterized in that said flaring die 80 comprises four shaped cores 80*a*, 80*b*, 80*c*, 80*d*, in each one of which there is a quarter of said center channel 82, said shaped cores 80*a*, 80*b*, 80*c*, 80*d* being connected to one another through said joining means which comprise a plurality of pins 85 provided with a terminal head 86 and inserted in holes 83 made in said shaped cores 80*a*, 80*b*, 80*c*, 80*d* and in slotted holes 88 made in an annular ring nut 87 included between said shaped cores 80*a*, 80*b*, 80*c*, 80*d* and said terminal heads 86 of said pins 85, the rotation of said annular ring nut 87 being suited to transmit to said shaped cores 80*a*, 80*b*, 80*c*, 80*d* a radial movement away from or towards each other.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. While the dimensions and types of materials described herein are intended to define the parameters of the invention, they are by no means limiting, but are instead exemplary embodiments. Many other embodiments will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the terms "comprising" and "wherein." Moreover, in the following claims, the terms "first," "second," and "third," are used merely as labels, and are not intended to impose numerical requirements on their objects. Further, the limitations of the following claims are not written in means-plus-function format and are not intended to be interpreted based on 35 U.S.C. § 112(f) unless and until such claim limitations expressly use the phrase "means for" followed by a statement of function void of further structure.

The present methods can involve any or all of the steps or conditions discussed above in various combinations, as desired. Accordingly, it will be readily apparent to the skilled artisan that in some of the disclosed methods certain steps can be deleted or additional steps performed without affecting the viability of the methods.

As will be understood by one skilled in the art, for any and all purposes, particularly in terms of providing a written description, all ranges disclosed herein also encompass any and all possible subranges and combinations of subranges thereof. Any listed range can be easily recognized as sufficiently describing and enabling the same range being broken down into at least equal halves, thirds, quarters, fifths, tenths, etc. As a non-limiting example, each range discussed herein can be readily broken down into a lower third, middle third and upper third, etc. As will also be understood by one skilled in the art all language such as "up to," "at least," "greater than," "less than," "more than" and the like include the number recited and refer to ranges which can be subsequently broken down into subranges as discussed above. In the same manner, all ratios disclosed herein also include all subratios falling within the broader ratio.

One skilled in the art will also readily recognize that where members are grouped together in a common manner, such as in a Markush group, the present invention encompasses not only the entire group listed as a whole, but each member of the group individually and all possible subgroups of the main group. Accordingly, for all purposes, the present invention encompasses not only the main group, but also the main group absent one or more of the group members. The present invention also envisages the explicit exclusion of one or more of any of the group members in the claimed invention.

An exclusive property right or privilege is claimed in the invention as defined by the following claims:

1. A pipe flaring device comprising:

a main body extending along a mainly longitudinal direction defined by a longitudinal axis;

a flaring unit wherein said flaring unit interacts with an end of pipe to be flared;

a die carrier arranged at a front of said flaring unit; and a flaring die wherein said flaring die is accommodated in said die carrier and provided with a center channel which houses said pipe to be flared;

wherein said die carrier further defines a shaped seat which accommodates said flaring die and is in communication with a shaped opening defined in said main body, said shaped opening being located between said flaring unit and said die carrier;

wherein said shaped seat defines a conical inner surface whose tapered end diverges towards said flaring unit and being configured so that it matches a conical outer surface of said flaring die;

wherein said shaped opening is defined in a lateral surface of said main body, wherein a length of said shaped opening measured along said longitudinal axis exceeds a length of said flaring die likewise measured along said longitudinal axis, and wherein a width of said shaped opening, measured crosswise with respect to said longitudinal axis, exceeds a width of said flaring die and a width of said shaped seat, both measured crosswise with respect to said longitudinal axis;

wherein said flaring die comprises two shaped cores that are joined to each other and are openable by an elastic rotation unit, and wherein a half of said center channel is defined in each one of said shaped cores;

wherein said elastic rotation unit comprises a pair of pins comprising a first pin and a second pin, each coupled into a corresponding shaped core and arranged so that each pin passes through at least one joining bracket housed in a seat that extends over both of said shaped cores, wherein a helical spring is externally coupled with at least first of said pins, said helical spring having one end that is placed in contact with one of said shaped cores and a second end that interferes with the second pin.

2. The pipe flaring device of claim 1 wherein a width of said shaped opening, measured crosswise with respect to said longitudinal axis, is smaller than the width of said main body, likewise measured crosswise with respect to said longitudinal axis.

3. The pipe flaring device of claim 1 wherein a through opening is defined in said die carrier along the direction defined by said longitudinal axis and wherein said through opening aligns with said shaped opening.

4. The pipe flaring device of claim 1 wherein said flaring unit comprises:

a center core coaxially defined in said main body along said longitudinal axis;

a flaring cone located in the center core and facing towards said flaring die; and a maneuvering means suited to move said center core coaxially inside said main body and along said longitudinal axis.

5. The pipe flaring device of claim 4 wherein said flaring cone is provided with a pin housed in a hole made in said center core where rolling means being interposed between said pin and said hole.

6. The pipe flaring device of claim 5 wherein said maneuvering means comprises:

a tube mechanically associated with said center core and provided with a maneuvering member that projects from said main body on opposite side of said flaring cone; and a screw means for connecting said tube inside said main body.

7. The pipe flaring device of claim 6 wherein said screw means comprises:

a male thread created on the outside of said tube; and a female thread created in a sleeve that is stably coupled into said main body and into which said center core is slidingly coupled.

8. The pipe flaring device of claim 7 further comprising: a bearing arranged in such a way that it is coaxially aligned with said sleeve and interposed between said main body and said center core.

9. The pipe flaring device of claim 6 wherein said tube is mechanically associated with said center core through a connection rod having a first end fixed to said center core and a second end, opposite said first end, is slidingly received into said tube and wherein said center core is connected to the tube through a pin fixed to said second end and slidingly associated into a slot made in said tube.

10. The pipe flaring device of claim 9 further comprising:

an elastic unit coaxially associated with the outside of said connection rod and interposed between said center core and said tube.

11. The pipe flaring device of claim 4 wherein said flaring cone is configured to interact with an end of a pipe to be flared.

12. The pipe flaring device of claim 1 wherein said die carrier which accommodates a flaring die is located at one end of the flaring device.

13. The pipe flaring device of claim 1 wherein said die carrier is fixed to the pipe flaring device main body using screws.

14. The pipe flaring device of claim 1 wherein said die carrier is produced as a single piece.

15. The pipe flaring device of claim 4 wherein said maneuvering means comprises a sleeve and the center core is slidably received by the sleeve.

16. The pipe flaring device of claim 10 wherein said elastic unit comprises an elastic ring.

17. The pipe flaring device of claim 16 wherein said elastic unit further comprises two elastic elements.

18. The pipe flaring device of claim 4 wherein a flare formed at an end of the pipe is obtained through plastic deformation of the pipe between the flaring cone and the flaring die.

* * * * *